US009231289B2

(12) United States Patent
Chong et al.

(10) Patent No.: US 9,231,289 B2
(45) Date of Patent: Jan. 5, 2016

(54) METHODS AND DEVICES FOR PROVIDING A COMPACT RESONATOR

(71) Applicant: Radio Frequency Systems, Inc., Meriden, CT (US)

(72) Inventors: Yin-Shing Chong, Middletown, CT (US); Stanley Michnowicz, East Hampton, CT (US); Yunchi Zhang, Wallingford, CT (US)

(73) Assignee: Alcatel-Lucent Shanghai Bell Co. Ltd., Shanghai (CN)

( * ) Notice: Subject to any disclaimer, the term of this patent is extended or adjusted under 35 U.S.C. 154(b) by 305 days.

(21) Appl. No.: 13/891,343

(22) Filed: May 10, 2013

(65) Prior Publication Data

US 2014/0333394 A1 Nov. 13, 2014

(51) Int. Cl.
*H01P 11/00* (2006.01)
*H01P 7/04* (2006.01)

(52) U.S. Cl.
CPC ..... *H01P 7/04* (2013.01); *Y10T 29/49016* (2015.01)

(58) Field of Classification Search
CPC ..... H01P 1/20; H01P 7/00; H01P 11/008
USPC ..... 333/222
See application file for complete search history.

(56) References Cited

U.S. PATENT DOCUMENTS 6,078,231 A * 6/2000 Pelkonen ..... H01P 1/2053 333/134
7,777,593 B2 * 8/2010 Weitzenberger ..... 333/134
2001/0026202 A1 * 10/2001 Raty ..... H01P 7/04 333/222

* cited by examiner

*Primary Examiner* — Stephen E Jones
*Assistant Examiner* — Erfan Faneian
(74) *Attorney, Agent, or Firm* — Capitol Patent & Trademark Law Firm, PLLC

(57) ABSTRACT

A compact resonator is provided which includes a coupling that is connected to the resonator in between a resonator body and pedestal. The coupling may be keyed or otherwise fixed to prevent it from moving. Both deep drawn and solid resonator designs are provided.

21 Claims, 7 Drawing Sheets

METHODS AND DEVICES FOR PROVIDING A COMPACT RESONATOR

BACKGROUND

Existing wireless base stations utilize resonators as a part of an amplification system. FIG. 1 depicts a typical installation of a resonator 1. As shown, a resonator body 2 rests on a pedestal 3 that includes a tab portion 4 that extends from the pedestal 3. Attached to the tab portion 4 is a conductive, input/output (I/O), coupling loop 5. The loop 5 is typically made from a wire that is used to connect the resonator 1 to a tower mounted antenna or amplifier. Typically, the loop 5 is attached to the resonator tab 4 using a screw 6. Because the tab portion 4 extends from the pedestal 3, space is needed for the portion 4. Further, many times the shape of the loop 5 requires that additional space be allocated within the resonator cavity 7 (e.g., it extends from the extended tab portion 4). However, many times the area available to install a resonator is limited to a small amount of space. In such a scenario, it is difficult to install the resonator 1 because it requires space for the extended tab portion 4 and the loop 5.

It is therefore desirable to provide methods and devices for providing a compact resonator that may be installed within a relatively small amount of space.

The electrical performance of a resonator is also important. Thus, while it is desirable to design a resonator that fits within a small amount of space, the performance of such a resonator should not be sacrificed.

It is further desirable to provide methods and devices for providing a compact resonator that provides improved electrical performance.

SUMMARY

Exemplary embodiments of methods and devices for providing a compact resonator are provided.

According to an embodiment, one exemplary resonator may comprise: a pedestal configured to receive a resonator body and a conductive coupling; a resonator body configured to be secured to the pedestal; and a conductive coupling configured to be received between the pedestal and the resonator body. The conductive coupling may comprise a conductive material (e.g., a copper wire), or a non-ferrous metal plate, for example.

In additional embodiments, to insure that the coupling does not move the pedestal may comprise pedestal means for fixing a position of the conductive coupling, such as a raised or lowered pedestal key portion, while the conductive coupling may comprise coupling means for further fixing the position of the conductive coupling, such as a slotted or raised coupling key portion, for example.

Because the resonator does not use a tab portion the amount of space needed to install a resonator may be reduced. In an additional embodiment of the invention, the coupling may further comprise a resonator connection portion configured to position the conductive coupling substantially within a resonator cavity, further insuring the resonator (including its coupling) may fit within a small amount of space allotted to a cavity.

Yet further, the resonator may comprise a solid or deep-drawn resonator to name just two examples. Still further, the resonator may comprise means for securing the resonator body to the pedestal, such as (i) a resonator body, extension portion configured to secure the resonator body to the pedestal and a pedestal reception portion configured to receive the resonator body, extension portion (i.e., for a solid resonator embodiment), or (ii) a screw and washer combination (i.e., for a deep drawn resonator embodiment).

Resonators provided by the present invention be a part of a tower mounted amplifier or antenna, for example.

In addition to the resonators described above and herein, the present invention also provides for resonator coupling methods. In one embodiment, such a method may comprise: configuring a pedestal to receive a resonator body and a conductive coupling; configuring a resonator body to be secured to the pedestal; and configuring a conductive coupling to be received between the pedestal and the resonator body. The methods may be used with a solid resonator or a deep-drawn resonator, to name just two examples of the types of resonators the method(s) may be used with. Similar to the description above regarding the inventive resonators, the conductive coupling may comprise a conductive material (e.g., a copper wire), or a non-ferrous metal plate, and to insure that the coupling does not move the method may further comprise fixing a position of the conductive coupling using a raised or lowered pedestal key portion, and using a slotted or raised coupling key portion.

In additional embodiments, the method may further comprise securing the resonator body to the pedestal using (i) a resonator body, extension portion, and a pedestal reception portion configured to receive the resonator body, extension portion (i.e., solid resonator embodiment), or (ii) a screw and washer combination (deep-drawn resonator embodiment).

The method(s) may be used in resonators that are a part of tower mounted amplifiers or antennas.

Because the methods do not make use of a tab portion the amount of space needed to install a resonator may be reduced. In an additional embodiment of the invention, the conductive coupling may be positioned substantially within a resonator cavity using a resonator connection portion to further insure that a resonator (including its coupling) may fit within a small amount of space allotted to a cavity.

Additional features of the inventions will be apparent from the following detailed description and appended drawings.

DETAILED DESCRIPTION, INCLUDING EXAMPLES

Figure 1:
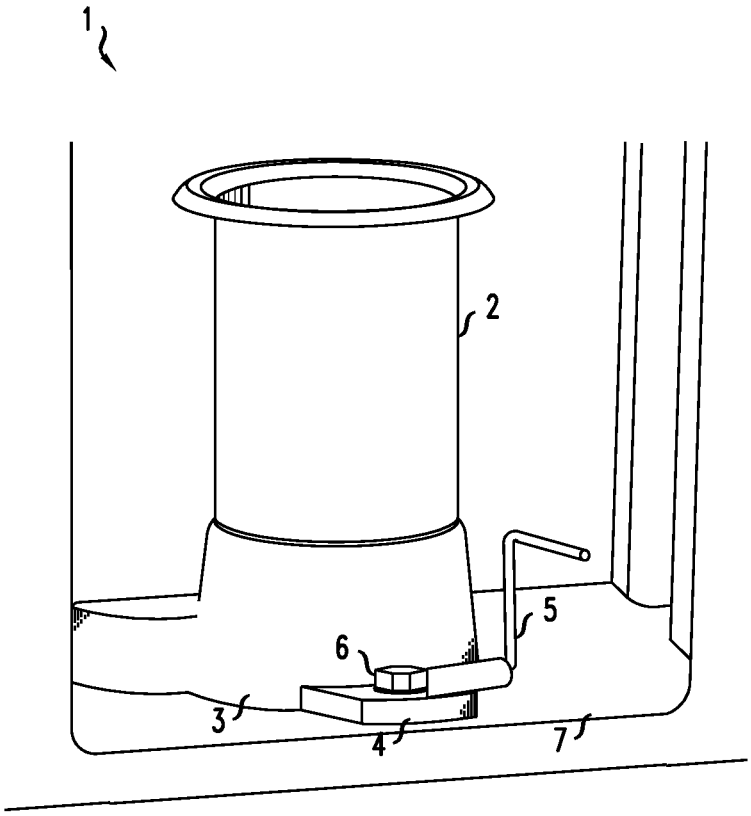
FIG. 1 depicts a resonator that utilizes an extended tab portion to connect an I/O coupling loop.

Exemplary embodiments of compact resonators and methods for providing the same are described herein in detail and shown by way of example in the drawings. Throughout the following description and drawings, like reference numbers/characters refer to like elements.

It should be understood that, although specific exemplary embodiments are discussed herein there is no intent to limit the scope of the present invention to such embodiments. To the contrary, it should be understood that the exemplary embodiments discussed herein are for illustrative purposes, and that modified and alternative embodiments may be implemented without departing from the scope of the present invention.

Specific structural and functional details disclosed herein are merely representative for purposes of describing the exemplary embodiments. The inventions, however, may be embodied in many alternate forms and should not be construed as limited to only the embodiments set forth herein.

It should be noted that some exemplary embodiments are described as processes or methods depicted in a flow diagram. Although the flow diagram may describe the processes/methods as sequential, many of the processes/methods may be performed in parallel, concurrently or simultaneously. In addition, the order of each step within processes/methods may be re-arranged. The processes/methods may be terminated when completed, and may also include additional steps not included in the flow diagram.

As used herein, the term "and/or" includes any and all combinations of one or more of the associated listed items. It should be understood that when an element is referred to as being "connected", or "mated" to another element, or described as receiving another element it may be directly connected or mated to the other element, directly receive the other element or intervening elements may be present, unless otherwise specified. Other words used to describe connective or spatial relationships between elements or components (e.g., "between") should be interpreted in a like fashion. As used herein, the singular forms "a," "an" and "the" are not intended to include the plural form, unless the context indicates otherwise.

As used herein, the term "embodiment" refers to an exemplary embodiment of the present invention.

Figure 2A:
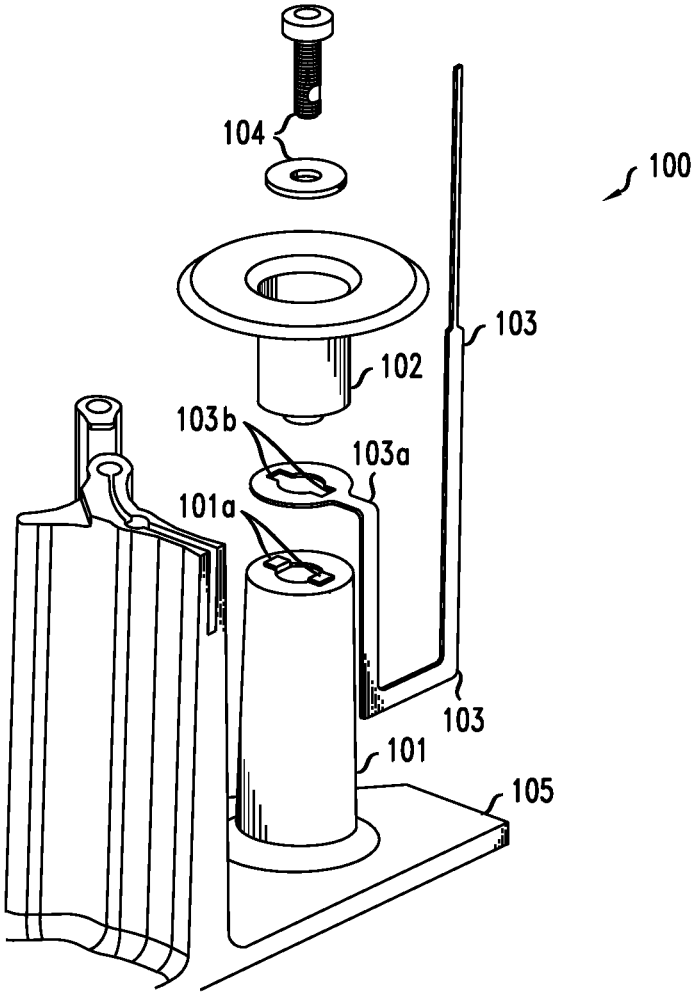
FIG. 2*a* depicts an "exploded" view of a resonator according to an embodiment of the invention.
Figure 2B:
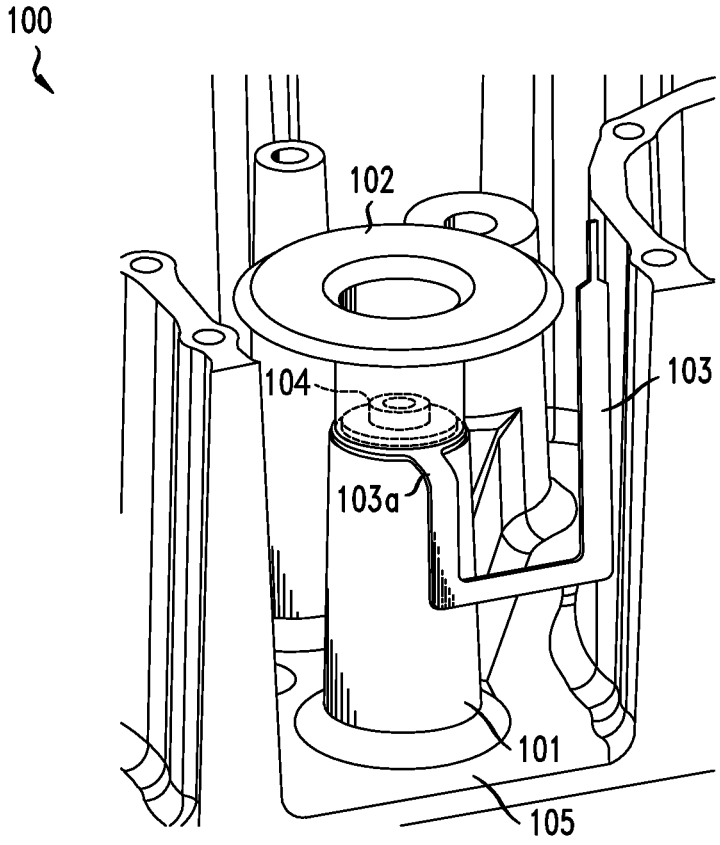
FIG. 2*b* depicts a view of the resonator depicted in FIG. 2*a* as it may be connected (i.e., unexploded view) according to an embodiment of the invention.

FIGS. 2*a* and 2*b* depict a resonator 100 in accordance with an embodiment of the invention. FIG. 2*a* depicts an "exploded" view of the resonator 100, while FIG. 2*b* depicts a connected or "unexploded" view of the resonator 100. Referring to FIG. 2*a*, as shown the resonator 100 may comprise a pedestal 101 configured to receive a resonator body 102 that may be secured to the pedestal 101, and a conductive coupling 103. In an embodiment of the invention, the conductive coupling 103 may be configured to be received between the pedestal 101 and the resonator body 102. The coupling 103 may further comprise a resonator connection portion 103*a* configured to position the conductive coupling 103 substantially within a resonator cavity 105. The embodiments depicted in FIGS. 2*a*, 2*b* eliminate the need to use an extended tab portion to connect a coupling. Accordingly, the space needed to install the resonator 100 may be reduced permitting the resonator 100 to be installed within a relatively small amount of space.

In an embodiment of the invention the coupling 103 may comprise a non-ferrous metal plate with a diameter between 0.010 and 0.040 inches, for example. Further, the coupling 103 may comprise a shape that fits within the space allotted to the resonator cavity 105. In an alternative embodiment of the invention, the coupling 103 may comprise a conductive wire made from a conductive material, such as copper, for example, and comprise a shape that fits within the space allotted to the resonator cavity 105. Accordingly, because the shape of the coupling fits within the shape of the cavity 105 less space is needed to install the resonator 100, including its coupling 103. Though the coupling 103 is depicted as being connected at one end to the resonator body 2, and unconnected at its opposite end it should be understood that the opposite end of the resonator may extend further and be connected to an amplifier or antenna, for example (connection not shown in FIGS. 2*a*, 2*b*).

The resonator 100 may further comprise pedestal means 101*a* that may be used for fixing a position of the conductive coupling 103. In one embodiment of the invention, the pedestal means 101*a* may comprise a raised key portion. The raised key portion may comprise a set of raised sections that may operate as a key that fixes a position of the coupling 103 so that coupling does not rotate, or otherwise move, for example. In an alternative embodiment, the pedestal means 101*a* may comprise a lowered key portion (not shown in FIG. 2*a* for the sake of clarity) that comprises a set of lowered sections that may also operate as a key to fix the coupling 103 in a position. In an embodiment of the invention, the coupling 103 may also comprise coupling means 103*b* that may be configured to fix the position of the coupling 103. For example, the coupling means 103*b* may be operable to mate with pedestal means 101*a* in order to fix a position of the conductive coupling 103. In an embodiment of the invention, to allow the pedestal means and coupling means 103*b* to mate or otherwise be connected to one another to fix the position of the coupling 103, the pedestal means 101*a* may comprise a raised key portion while the coupling means 103*b* may comprise a slotted key portion. In an alternative embodiment, the pedestal means 101*a* may comprise a lowered key portion while the coupling means may comprise a raised key portion. It should be understood that the term "raised" means "extended from", as in extended from a pedestal or coupling, for example. Depending on the orientation of the resonator a raised portion may extend upwards, downwards or sideways, for example.

FIG. 2*a* also depicts an example of how the resonator body 102 may be secured to the pedestal 101. As shown, in one embodiment of the invention the resonator 100 may comprise means for securing 104 the resonator body 102 to the pedestal 101. In one embodiment of the invention, the means 104 may comprise a screw and washer combination 101, for example. In the embodiment depicted in FIG. 2*a* the resonator body 102 may comprise a deep drawn resonator made from a thin metal sheet. In one embodiment of the invention, the resonator 100 may operate over a range of frequencies, including 698 MHz to 960 MHz, 1700 MHz to 2700 MHz, as well as other frequency ranges, and may be a part of a tower mounted amplifier, or antenna, such as a low band tower mounted amplifier to name just one of the many types of amplifiers and antennas covered by the present invention.

Figure 3A:
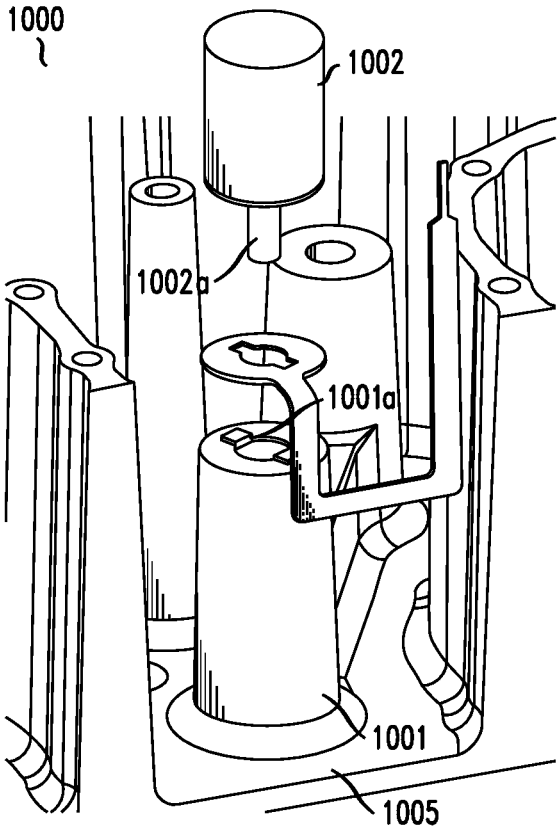
FIGS. 3*a-c* depict a resonator according to yet another embodiment of the invention.
Figure 3B:
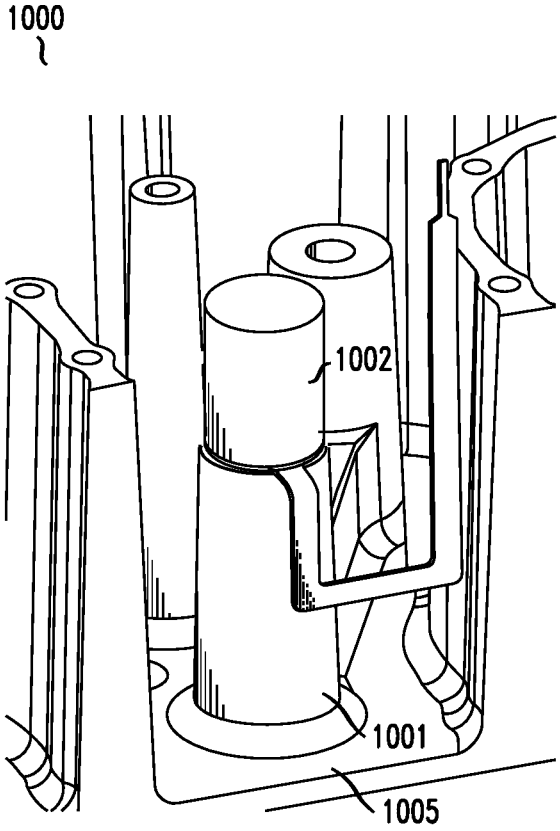
Figure 3C:
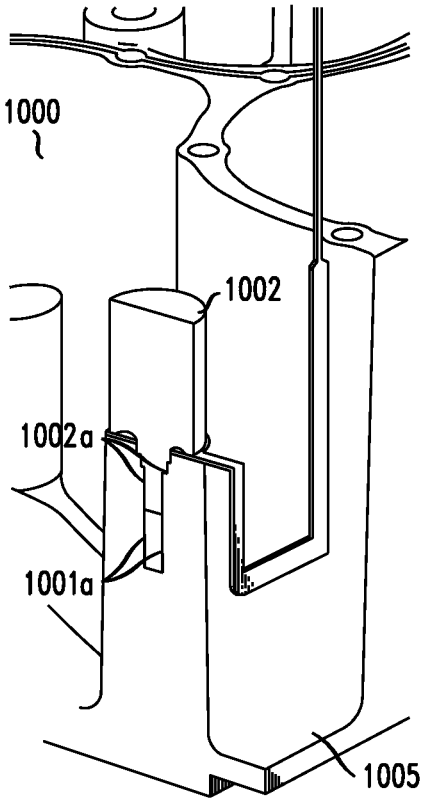

Referring now to FIGS. 3*a-c* there is depicted a resonator 1000 according to yet another embodiment of the invention. The resonator 1000 shown in FIGS. 3*a-c* may include many of the same components as the resonator 100 in FIGS. 2*a,b*. However, the resonator 1000 shown in FIG. 3*a-c* is a solid resonator, instead of a deep drawn resonator. FIG. 3*a* depicts a resonator body 1002 prior to being connected to a pedestal 1001, FIG. 3*b* depicts the resonator body 1002 connected to the pedestal 1001, and FIG. 3*c* depicts a cut-away view of the resonator body 1002 as connected to the pedestal 1001.

Referring to FIG. 3*a*, in an embodiment of the invention the resonator 1000 may comprise means for securing a resonator body 1002 to a pedestal 1001 within cavity 1005, for example, a resonator body extension portion 1002*a* and/or a pedestal reception portion 1001*a*. The pedestal reception portion 1001*a* may be configured to receive and/or mate with the resonator body extension portion 1002*a* in order to secure the resonator body 1002 to the pedestal 1001. Referring to FIG. 3*c*, there is depicted a cut-a-way view of the resonator body extension portion 1002*a* connected, or mated, to the pedestal reception portion 1001*a* within cavity 1005. In embodiments of the invention, one or both portions 1001*a*, 1002*a* may be threaded or partially threaded.

The inventors have found that resonators provided by the present invention may provide a higher quality factor (so-called "Q factor") due at least in part to the smaller space utilized within a resonator cavity. Further, such resonators provide improved intermodulation performance due to the metal-to-metal contact that results when a coupling is connected to a resonator body as described herein.

Figure 4:
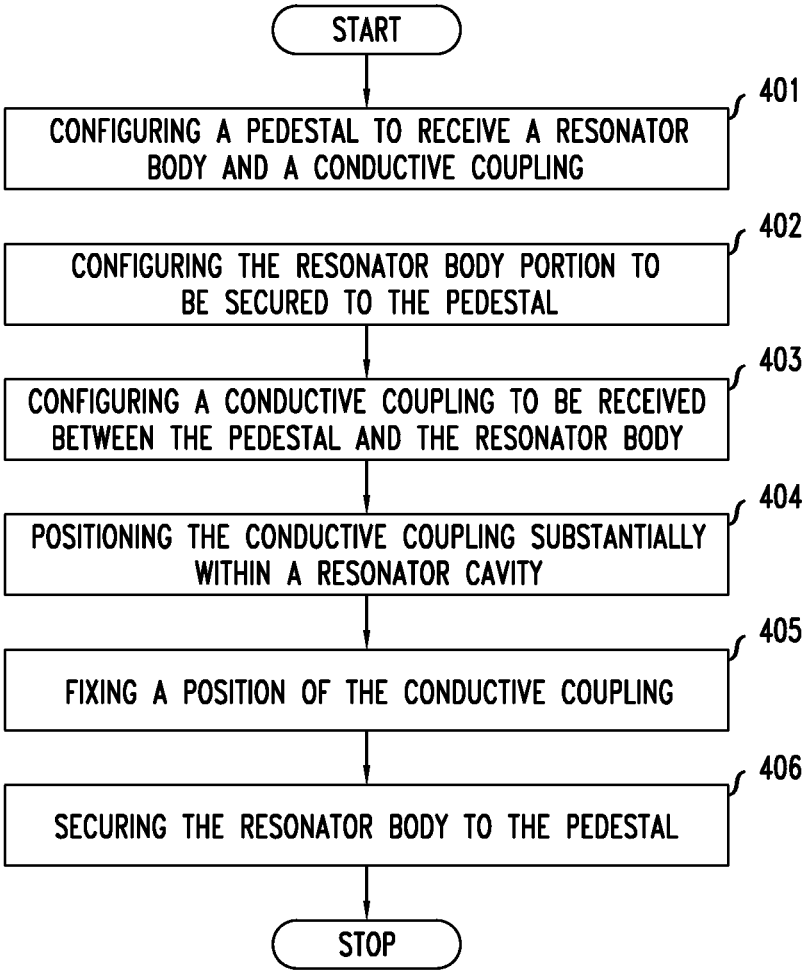
FIG. 4 illustrates a flow diagram of one or more methods for providing a compact resonator according to embodiments of the invention.

FIG. 4 depicts a flow diagram of one or methods for providing a compact resonator according to embodiments of the invention. As depicted in FIG. 4, one exemplary method may comprise a resonator coupling method which may comprise configuring a pedestal, such as the pedestals shown in FIGS. 2*a,b* and 3*a-c*, to receive a resonator body and a conductive coupling, such as those shown in FIGS. 2*a,b* and 3*a-c*, in step 401, configuring the resonator body to be secured to the pedestal, in step 402, and configuring a conductive coupling to be received between the pedestal and the resonator body, in step 403. The method may further comprise positioning the conductive coupling substantially within a resonator cavity, such as the cavities shown in FIGS. 2*a,b* and 3*a-c*, in step 404, using a resonator connection portion, for example.

In addition the method may comprise fixing a position of the conductive coupling, in step 405, using a raised or lowered pedestal key portion, and using a slotted or raised coupling key portion, for example. Yet further, the method may comprise securing the resonator body to the pedestal, in step 406, using a resonator body, extension portion and/or using a pedestal reception portion configured to receive and/or mate with the resonator body portion (solid resonator), or using a screw and washer combination (deep drawn resonator), for example.

In alternative embodiments of the invention the resonator body may comprise a deep drawn resonator, or a solid resonator. Yet further, the resonator may be configured to operate over a range of frequencies, including 698 MHz to 960 MHz, 1700 MHz to 2700 MHz, and other frequency ranges, and may be a part of a tower mounted amplifier, or antenna, such as a low band tower mounted amplifier to name just one of the many types of amplifiers and antennas covered by the present invention.

The conductive coupling may comprise a conductive wire made from a conductive material, such as copper, for example. Alternatively, the coupling may comprise a non-ferrous metal plate with a diameter between 0.010 and 0.040 inches, for example.

While exemplary embodiments have been shown and described herein, it should be understood that variations of the disclosed embodiments may be made without departing from the spirit and scope of the claims that follow.

We claim:

1. A resonator comprising:

a pedestal configured to receive a resonator body and a conductive coupling configured to be received between the pedestal and the resonator body, the resonator body configured to be secured to the pedestal; and wherein the pedestal further comprises a pedestal key portion for fixing a position of the conductive coupling.

2. The resonator as in claim 1, wherein the pedestal key portion comprises a raised or lowered key portion.

3. The resonator as in claim 1, wherein the conductive coupling comprises a coupling portion for fixing a position of the conductive coupling.

4. The resonator as in claim 3, wherein the coupling portion comprises a slotted or raised coupling key portion.

5. The resonator as in claim 1, further comprising a resonator body extension portion configured to secure the resonator body to the pedestal, and a pedestal reception portion configured to receive the resonator body extension portion.

6. The resonator as in claim 1, further comprising a screw and washer combination for securing the resonator body to the pedestal.

7. The resonator as in claim 1, wherein the resonator comprises a deep drawn resonator or a solid resonator.

8. The resonator as in claim 1, wherein the conductive coupling comprises a conductive material.

9. The resonator as in claim 1, wherein the conductive coupling comprises a non-ferrous metal plate.

10. The resonator as in claim 1, wherein the conductive coupling further comprises a resonator connection portion configured to position the conductive coupling substantially within a resonator cavity.

11. The resonator as in claim 1, wherein the resonator is a part of a tower mounted amplifier or antenna.

12. A resonator comprising:

a pedestal;

a resonator body; and a conductive coupling, wherein said pedestal is configured to receive said resonator body and said conductive coupling is configured to be received between said pedestal and said resonator body, and wherein said pedestal and said conductive coupling are keyed to fix a position of said conductive coupling to relative to said pedestal.

13. The resonator as in claim 12, further comprising a resonator body extension portion configured to secure the resonator body to the pedestal, and a pedestal reception portion configured to receive the resonator body extension portion.

14. The resonator as in claim 12, wherein the resonator is a part of a tower mounted amplifier or antenna.

15. A resonator coupling method comprising:

configuring a pedestal to receive a resonator body and a conductive coupling;

configuring a resonator body to be secured to the pedestal; and configuring a conductive coupling to be received between the pedestal and the resonator body by fixing the position of the conductive coupling using a pedestal key portion.

16. The method as in claim 15 further comprising fixing the position of the conductive coupling using a slotted or raised coupling key portion.

17. The method as in claim 15 further comprising securing the resonator body to the pedestal using a resonator body extension portion and a pedestal reception portion configured to receive the resonator body extension portion.

18. The method as in claim 15 further comprising securing the configured resonator body to the pedestal using a screw and washer combination.

19. The method as in claim 15, wherein the resonator body comprises a deep drawn resonator or a solid resonator.

20. The method as in claim 15, wherein the conductive coupling comprises a conductive material or a non-ferrous metal plate.

21. The method as in claim 15 further comprising positioning the conductive coupling substantially within a resonator cavity using a resonator connection portion.

* * * * *